United States Patent [19]

Bartels

[11] Patent Number: 4,513,909

[45] Date of Patent: Apr. 30, 1985

[54] FUEL BURNER CONTROL SYSTEM WITH LOW FIRE HOLE

[75] Inventor: James I. Bartels, Hudson, Wis.

[73] Assignee: Honeywell Inc., Minneapolis, Minn.

[21] Appl. No.: 651,489

[22] Filed: Sep. 17, 1984

[51] Int. Cl.[3] ..... F22B 35/00; G05D 15/00

[52] U.S. Cl. ..... 236/26 R; 122/448 R; 236/1 EB; 236/78 D

[58] Field of Search ..... 236/78 D, 26 E, 26 A, 236/26 R, 1 EB; 237/8 R, 65; 122/448 R

[56] References Cited

U.S. PATENT DOCUMENTS 3,486,693 12/1969 Stang, Jr. et al. ..... 236/78 D X 4,003,342 1/1977 Hodgson ..... 122/448 R

*Primary Examiner*—William E. Wayner

*Attorney, Agent, or Firm*—Alfred N. Feldman

[57] ABSTRACT

A boiler control utilizing a pressure sensor is provided that operates the system in the low fire mode if the load is light and can be satisfied in that mode. If the low fire operation is inadequate to hold the load, and the pressure drops, the boiler is then operated in a modulating mode which includes a high fire limit.

8 Claims, 3 Drawing Figures

FUEL BURNER CONTROL SYSTEM WITH LOW FIRE HOLE

CROSS-REFERENCE TO RELATED APPLICATION

The present application is being filed on even data with an application entitled Adaptive Low Fire Hold Control System, Ser. No. 651,490, by the same inventor and assigned to the assignee of the present application.

BACKGROUND OF THE INVENTION

The transfer of energy to and from a working fluid typically is accomplished under the control of a condition sensing device such as a temperature responsive unit or a pressure responsive unit. Ordinarily, the condition responsive means measures a single condition of the working fluid and in turn controls the rate of transfer of energy to or from the working fluid in proportion to the deviation from a set point. This type of control system typically has a proportional offset which is an offset from the desired setpoint or control point established for the operation of the system.

In many systems, there is a minimum or fixed lowest possible energy transfer rate for the system. Above that minimum rate, the system typically can modulate continuously to some fixed upper limit. There are startup energy losses associated with the transition between a complete off state and the lowest operating rate, and therefore each time the system is caused to cycle there is a significant startup loss.

The startup losses, and the operation of the system with a proportional offset, typically leads to certain inefficiencies. A more efficient manner of operating such a system can be brought about by minimizing the number of startup times for the system, and by tailoring the operation of the control so that the working fluid is not over heated to supply just the minimum amount of energy required to satisfy a particular load.

A description of a prior art type of condition control system will be described in the section of the application entitled "Description of the Preferred Embodiment" with reference to FIG. 1 which is identified as prior art. This description will establish what some of the prior art is, and will show why that type of prior art control system is deficient as relates to an efficient manner of operating a condition control system. The system that will be described will specifically be a boiler supplying steam to a steam heated load in response to a fuel burner control system. A further prior art system which provides an economical and efficient manner of operating is also disclosed in U.S. Pat. No. 4,373,663 issued Feb. 15, 1983, to J. M. Hammer.

The present description will be directed primarily to boilers in which water is converted to steam and then applied as the working fluid to a load. Under these conditions, a pressure sensor determines the condition of the working fluid and this type of system operates with a fuel burner that is initially operated to a low fire rate, and then released to a high fire rate. Typically this type of system operates in a modulating manner between the two fixed rates in order to satisfy the demand for steam from the boiler. The pressure sensor regulates the burner. This type of system is inefficient in that each time the burner starts, losses accompany the startup, and further the system is inefficient in that the pressure sensor normally provides a much higher pressure than is necessary to efficiently satisfy the load.

SUMMARY OF THE INVENTION

A boiler operating scheme somewhat similar to tha disclosed in the Hammer U.S. Pat. No. 4,373,663 can be implemented in a highly simplified form by the use of an existing pressure operated modulating control and relay switching circuits. A typical boiler installation normally has a pressure responsive control mounted thereon. If a modified form of this device is provided, a boiler operating system can be developed which provides for the adjustment of the burner output or fire size to match the load demand on the boiler. The boiler firing rate is a function of boiler pressure and with this highly simplified arrangement a more efficient boiler operating arrangement can be provided wherein a low fire operation of a boiler can be tested to determine whether the low fire operation is capable of satisfying the existing demand. If the low fire operation is capable of supplying the existing demand, the boiler operating cycle is extended and energy is saved due to the reduction in number of cycles needed and their relatively long operating time. If the boiler demand cannot be met at the low fire operating point, the system automatically switches to a normal high fire and modulating mode to provide a response to the higher load level. Each time the burner is initiated for the system, a check is automatically made to determine if the low fire setting is capable of supplying the demand.

The present invention can be accomplished by a double potentiometer arrangement, a transistor switching circuit, and two conventional relays. Existing pressure responsive boiler controls can be readily modified. A control having two potentiometers and wiper mechanisms responsive to pressure have been sold in this market for a substantial period of time and are readily available for the implementation of this invention.

In accordance with the present invention, there is provided a control system adapted to control a fuel burner having a low fire mode, and a modulating mode including a high fire limit of operation for a boiler to provide a fluid pressure, including: pressure responsive means responsive to said fluid pressure in said boiler; said pressure responsive means having two variable impedance means with said two variable impedance means being operated together in response to changes in said pressure; switching circuit means connected to a source of potential and including two switching means with said switching means capable of being energized from said source of potential; a first of said switching means being energized upon said fluid pressure causing a first of said variable impedance means to approach a minimum desirable fluid pressure for said boiler; said first switching means having at least one switchable circuit to control said fuel burner in said low fire mode of operation; a second of said switching means being energized upon said first of said variable impedance means reaching said minimum desirable pressure for said boiler; said second of said switching means having a normally open switchable circuit and a normally closed switchable circuit; and a second of said variable impedance means adapted to be connected through said second switching means switchable circuits to control said fuel burner in said modulating mode when said second switching means is energized.

DESCRIPTION OF THE PREFERRED EMBODIMENT

Figure 1:
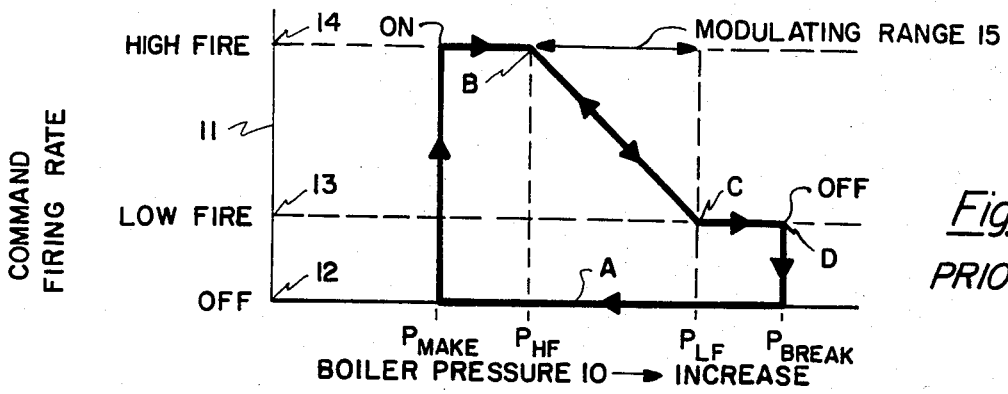
Fig. 1 PRIOR ART
FIG. 1 is a prior art conventional proportional system that includes an on/off control.

In FIG. 1 a typical operating cycle for a boiler is disclosed. The boiler pressure 10 is plotted versus the firing rate 11. The boiler pressure 10 increases from left to right and the firing rate is indicated as either being "off" at 12, being at low fire 13, or being at high fire 14. A modulating range between the high fire 14 and the low fire 13 is disclosed at 15.

Assume the boiler has just shut down at pressure $P_{break}$. If there is a load on the boiler, the pressure will decrease along line A. When the pressure reaches $P_{make}$, the burner is started with the highest possible firing rate 14. The pressure will increase to a point B. At this pressure, the control begins to throttle back the burner firing rate. The control will then modulate the burner between point B at the high fire 14, and a point C to match the boiler load. If, however, the load is light, the pressure will continue to rise even at the lowest firing rate along line C to a point D. At point D the pressure is sufficiently high to cause the burner to shut down and the cycle is complete. This method of control provides very stable operation with a load that falls within the modulation range 15. This type of operation is undesirable for light loads because the firing of the burner above the lowest possible firing rate to meet the load requirements is inefficient and will cause rapid cycling of the burner sytem. This increases the wear on the mechanical parts, and also is inefficient in that the start up of a burner of large size normally entails prepurge and postpurge functions which vent combustion products to the atmosphere without being able to utilize any of the heat content in those combustion products.

Figure 2:
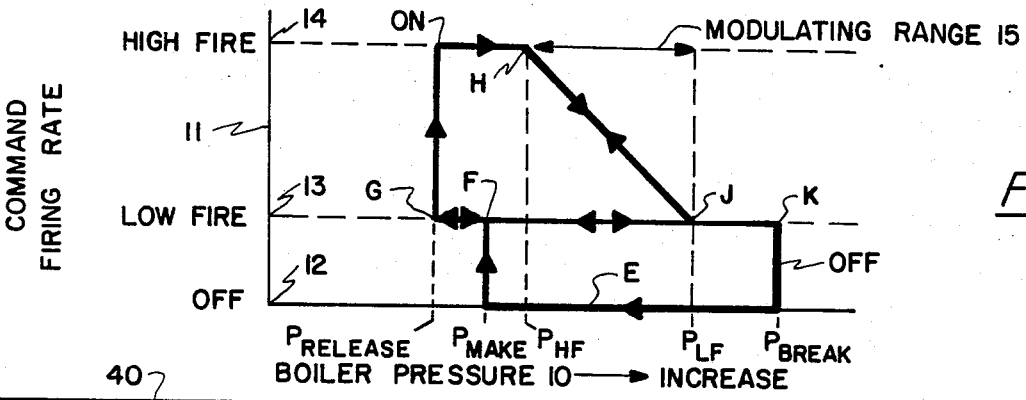
FIG. 2 is a representation of a proportional control system incorporating the present invention.

An improved method of pressure control is shown in FIG. 2. Again the boiler pressure 10 is plotted as increasing from left to right, and the "off" point 12, the low fire point 13, and the high fire point 14 are disclosed for the firing rate 11 of the boiler. A modulation range 15 is again provided. In this case assume that the boiler is "off" and that the pressure is falling along a line E. When the pressure falls to $P_{make}$, the boiler is brought on at the lowest possible firing rate 13 as indicated at point F. If the load is sufficiently large, the pressure will continue to fall from the point F to a point G. At this pressure the control recognizes the load requires a higher firing rate, and releases the system to the high fire 14, and subsequently to the modulation range 15. Modulation will result along the line H to J as in the example in FIG. 1.

If the load is small, however, the pressure will not fall from point F to point G. With a light load, the pressure will rise along the line F to a point J, while the burner for the boiler is held at a low fire position. The pressure will finally rise to the pressure $P_{break}$, and the burner will be shut down completing the cycle. The time required to complete this cycle is significantly longer compared to a typical control cycle because the pressure rises more slowly at a low fire rate 13 compared to a high fire rate 14. The desirable stability of the original control is still retained in the modulation mode. A further advantage of this arrangement is the ease with which it can be implemented. A control circuit capable of implementing this arrangement utilizing commercially available components is shown in the circuit of FIG. 3.

Figure 3:
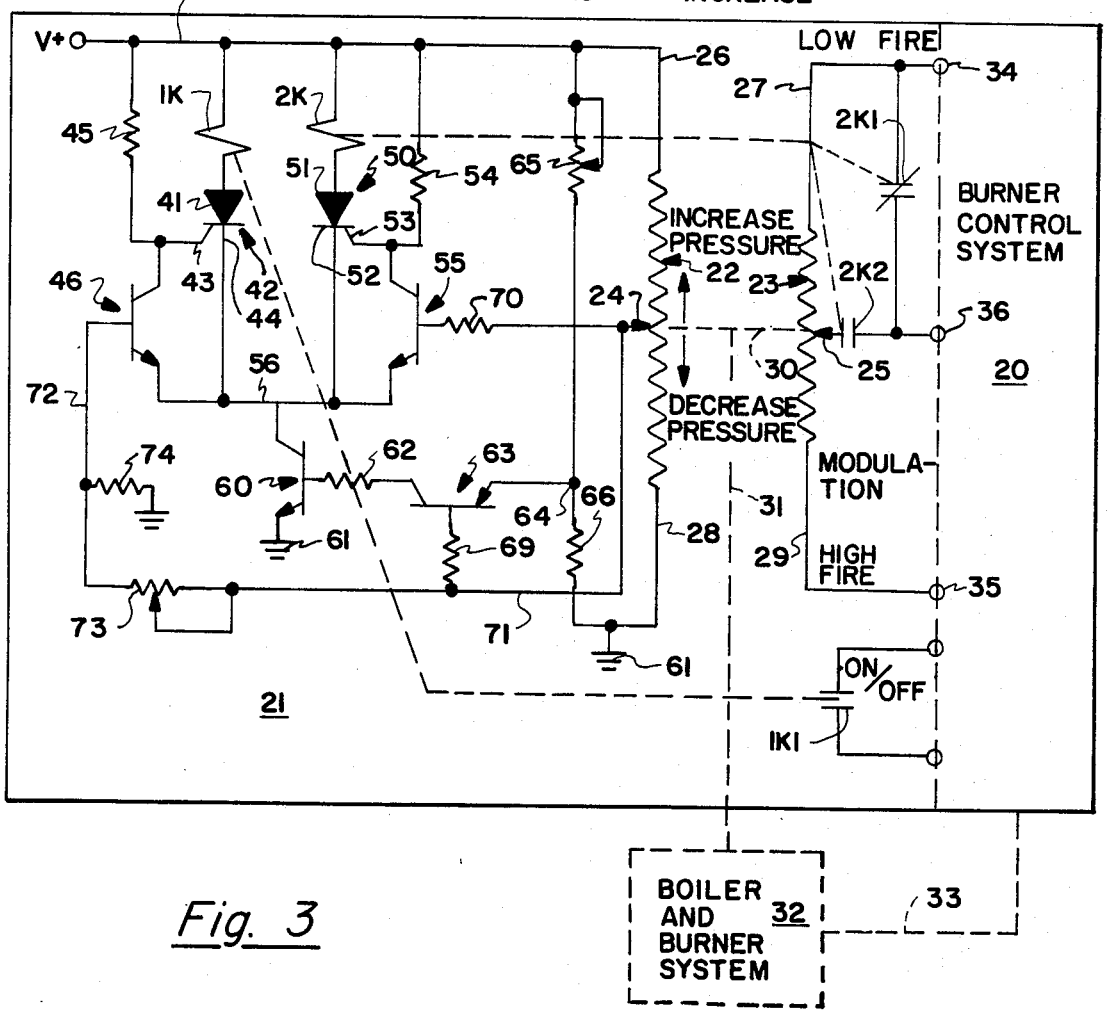
FIG. 3 is a schematic circuit of a switching circuit means incorporated in a burner control system.

In FIG. 3 a control system for a burner is disclosed at 20. The control system 20 includes a switching circuit means 21 that includes a pair of relays 1K and 2K. The switching circuit means 21 is connected to a pair of potentiometers 22 and 23. The potentiometers 22 and 23 are variable impedance means generally, but have been specifically shown as a pair of potentiometers. Potentiometers 22 has a wiper 24 while the potentiometers 23 has a wiper 25. The potentiometer 22 has a pair of ends 26 and 28, while the potentiometer 23 has a pair of ends 27 and 29. The two potentiometer wipers 24 and 25 are linked at 30 so that they move in unison and are driven by a pressure indicated at 31 from a boiler and burner system 32 of conventional design. The boiler and burner system 32 is operated in a conventional manner from the burner control system 20 as indicated at 33. The potentiometer arrangement of 22 and 23 could be of a type sold by Honeywell and identified as an L91 Modulating Pressuretrol. Minor mechanical modifications would be necessary to adapt the L91 Modulating Pressuretrol, but those modifications would be obvious. This device contains the two potentiometers 22 and 23 which can be operated in unison over a range of 0 to 135 ohms, which is the conventional range of variation in resistance to cause a burner control system to modulate between the high fire and low fire positions.

The potentiometer 23 is connected in the burner control system 20 in a conventional manner with the end 27 of the potentiometer connected to a terminal 34 of the burner control system 20 (in a manner normally associated with a modulating control). The lower end 29 is connected to terminal 35 which is the high fire operating end of the potentiometer 23. The potentiometer wiper 25 is connected through a normally open relay contact 2K2 from relay 2K to a terminal 36. A further normally closed relay contact 2K1 is connected between the terminals 34 and 36. With the relay contacts in the position shown in FIG. 3, the wiper 25 is disconnected from the circuitry, while the contact 2K1 shorts the terminals 34 and 35 which effectively puts the system into a low fire mode of operation. When the relay 2K is energized and the contact 2K2 is closed, and contact 2K1 is opened, the potentiometer wiper 25 is connected to the terminal 36 so that the system can modulate in response to the movement of the wiper by pressure to the linkage 30.

The switching circuit means 21 includes the two relays 1K and 2K. The 1K relay is connected between a source of potential 40 and the anode 41 of a silicon controlled rectifier generally disclosed at 42. The silicon controlled rectifier 42 has a gate 43 and a cathode 44. A resistor 45 connects the voltage source 40 to the gate 43, and to a transistor generally disclosed at 46. The transistor 46 is connected across the gate 43 to the cathode 44 of the silicon controlled retifier 42. It is obvious that when the transistor 46 is conducting, the silicon controlled rectifier 42 has no gate drive potential and would not be conductive.

The second relay 2K is connected between the source of potential 40 and a second silicon controlled recitifer generally disclosed at 50. The silicon controlled rectifier 50 has an anode 51, a cathode 52, and a gate 53. The gate 53 is connected through a resistor 54 to the source of potential 40. The gate 53 is connected through a further transistor 55 to the cathode 52 of the silicon controlled rectifier 50. The transistors 46 and 55, along with the cathodes 44 and 52, have a common juncture at 56 where they are connected through a transistor 60 to ground 61. The transistor 60 is connected through a resistor 62 to a further transistor 63 which is connected to a node 64 between two resistors 65 and 66 that form a voltage divider from the voltage source 40 to the ground 61.

The circuitry is completed by connecting the wiper 24 through a resistor 70 to control the transistor 55, while also providing a voltage on a conductor 71 to control the transistor 63 through a resistor 69 and by conductor 72 to control the transistor 46. A variable resistance 73 is provided in this circuit to adjust the pressure at which the system is operated, and the circuit is completed by the addition of a resistor 74 to the switching circuit means 21.

OPERATION OF FIG. 3

The potentiometers 22 and 23 make up a primary element of the switching circuit means 21 and can be obtained as indicated by modification of an existing L91 control. The boiler steam pressure acts on a diaphragm in the L91 (which is indicated at 31) and controls the wipers 24 and 25 of the potentiometers 22 and 23. A high pressure forces the wiper arms 24 and 25 towards the top of the potentiometers which is the low fire position. The potentiometer 23 is used in a standard fashion to provide modulation as disclosed in FIGS. 1 and 2. The potentiometer 22 is used as a pressure sensor and outputs a voltage to the switching circuit means 21.

If it is assumed that a high boiler pressure exists and that the boiler is not being fired, the operation is along line E of FIG. 2 at the pressure $P_{break}$. With a high pressure, the wiper 24 of the potentiometer 22 is at the top of potentiometer 22 and is therefore at the potential 40. This forces the transistors 46 and 55 into a "on" condition, and the transistor 63 to an "off" condition. The transistor 60 tracks the transistor 63 and is also "off". If the transistor 60 is "off", then the relays 1K and 2K are deenergized. The transistors 46 and 55 being conductive assures that the silicon controlled rectifiers 42 and 50 will remain "off". Since the 1K relay is the on/off control relay through the contact 1K1, the burner is not energized. As the pressure falls along the line E below $P_{break}$, the transistor 63 turns "on" and transistor 60 follows. The relays 1K and 2K remain "off", however, because the transistors 46 and 55 are still conducting thereby shunting current away from the gates 43 and 53 of the silicon controlled rectifiers 42 and 50.

The pressure continues to fall to the $P_{make}$ point of FIG. 2 along line E. The voltage at the transistor 46 is no longer sufficient to hold the transistor 46 "on" since the transistor 46 has a base that tracks the wiper position 24 of the potentiometer 22, which effectively is the boiler pressure. When the transistor 46 turns "off", the silicon controlled rectifier 42 then turns "on" and latches itself "on". This energizes the relay 1K and the burner control is operated in the on/off mode at the low fire position of FIG. 2 The burner is locked at low fire because the relay 2K is deenergized. The contacts 2K1 and 2K2 force a short circuit between the terminals 34 and 36 and an open circuit between the terminals 35 and 36, and this simulates a modulation potentiometer in the low fire position.

If the load is light, the pressure will rise along the line F to J to K of FIG. 2. The relay 2K will remain deenergized and the device will remain locked in the low fire mode. When the pressure reaches the point K or $P_{break}$, the voltage on wiper 24 will again force the transistors 63 and 60 "off" and the relay 1K will drop out deenergizing the burner.

If the load is greater than a load that the low fire operation can satisfy, the pressure will fall along line F to a point G. At point G, the transistor 55 turns "off" and the silicon controlled rectifier 50 is allowed to become conductive and latches itself "on". This causes the 2K relay to pull in and the 2K1 and 2K2 contacts change position. The control is thus released to a modulating state to allow the burner control sytem 20 to operate in the modulation range 15 of FIG. 2. Since the pressure is quite low (or near the end 29 of the potentiometer 23), the wiper 25 is at a position of high fire operation and the burner control system 20 thus forces the burner 32 into a high fire mode of operation. The control will then move to the modulation range 15 and will modulate until a reduction in load causes a pressure rise to force the wiper arrangement to the tops of the potentiometers 22 and 23. At this time the transistors 63 and 60, and the relays 1K and 2K will all turn "off" and the cycle is complete.

It is apparent from the present description that a highly simplified on/off/modulation boiler pressure control has been developed that is capable of holding the system in a low fire mode for light loads. A simple arrangement of a modified existing pressure control has been shown, but many modifications of the type of control and circuitry would be obvious to one skilled in the art. As such, the applicant wishes to be limited in the scope of this invention solely by the scope of the appended claims.

The embodiments of the invention in which an exclusive property or right is claimed are defined as follows:

1. A control system adapted to control a fuel burner having a low fire mode, and a modulating mode including a high fire limit of operation for a boiler to provide a fluid pressure, including: pressure responsive means responsive to said fluid pressure in said boiler; said pressure responsive means having two variable impedance means with said two variable impedance means being operated together in response to changes in said pressure; switching circuit means connected to a source of potential and including two switching means with said switching means capable of being energized from said source of potential; a first of said switching means being energized upon said fluid pressure causing a first of said variable impedance means to approach a minimum desirable fluid pressure for said boiler; said first switching means having at least one switchable circuit to control said fuel burner in said low fire mode of operation; a second of said switching means being energized upon said first of said variable impedance means reaching said minimum desirable pressure for said boiler; said second of said switching means having a normally open switchable circuit and a normally closed switchable circuit; and a second of said variable impedance means adapted to be connected through said second switching means switchable circuits to control said fuel burner in said modulating mode when said second switching means is energized.

2. A control system adapted to control a fuel burner having a low fire mode, and a modulating mode including a high fire limit of operation for a boiler to provide a fluid pressure, including: pressure responsive means responsive to said fluid pressure in said boiler; said pressure responsive means having two variable resistor means with said two variable resistor means being operated together in response to changes in said pressure; switching circuit means connected to a source of potential and including two relay means with said relay means capable of being energized from said source of potential; a first of said relay means being energized upon said fluid pressure causing a first of said variable resistor means to approach a minimum desirable fluid pressure for said boiler; said first relay means having at least one set of contacts to control said fuel burner in said low fire mode of operation; a second of said relay means being energized upon said first of said variable resistor means reaching said minimum desirable pressure for said boiler; said second of said relay means having a normally open contact and a normally closed contact; and a second of said variable resistor means adapted to be connected through said second relay contacts to control said fuel burner in said modulating mode when said second relay means is energized.

3. A control system adapted to control a fuel burner as claimed in claim 2 wherein said two variable resistor means are a pair of potentiometers with each potentiometer having a resistance and a wiper; and said wipers mechanically operated together in response to a change in pressure in said boiler.

4. A control system adapted to control a fuel burner as claimed in claim 3 wherein said switching circuit means is a solid state switching circuit.

5. A control system adapted to control a fuel burner as claimed in claim 4 wherein said two relay means are two individual electromagnetically operated relays.

6. A control system adapted to control a fuel burner as claimed in claim 5 wherein said solid state switching circuit includes a pair of silicon controlled rectifiers with one of said silicon controlled rectifiers controlling each of said relays.

7. A control system adapted to control a fuel burner as claimed in claim 6 wherein each of said silicon controlled rectifiers has an anode, a cathode, and a gate; said solid state switching circuit including a plurality of transistors; and a separate transistor of said solid state switching circuit connected from a gate to an anode of each of said silicon controlled rectifiers to control the conduction of said silicon controlled rectifiers and in turn controlling the operation of said relays.

8. A control system adapted to control a fuel burner as claimed in claim 7 wherein a further transistor of said plurality of transistors is connected from the cathodes of both of said silicon controlled rectifiers to a ground for said solid state switching circuits; and said further transistor including connection means to connect said further transistor to said wiper of said first of said potentiometers; said further transistor causing said silicon controlled rectifiers and said relays to be deenergized when said further transistor is nonconductive.

* * * * *